United States Patent [19]

Hargrove

[11] 4,122,956

[45] Oct. 31, 1978

[54] TOOL HOLDER APPARATUS FOR A WORKSTAND

[75] Inventor: Maxie G. Hargrove, Irving, Tex.

[73] Assignee: B & H Automotive, Dallas, Tex.

[21] Appl. No.: 818,459

[22] Filed: Jul. 25, 1977

[51] Int. Cl.[2] ..... A47F 3/14

[52] U.S. Cl. ..... 211/131; 108/28; 108/60; 108/94; 269/16

[58] Field of Search ..... 211/60 T, 131, 144; 248/218.4, 13, 3, 121, 122, 129, 225.3; 269/16; 108/27, 28, 94, 139, 150

[56] References Cited

U.S. PATENT DOCUMENTS

| | | | |
|---|---|---|---|
| 310,784 | 1/1885 | Bollinger | 211/131 X |
| 910,846 | 1/1909 | Paradis | 108/28 |
| 1,220,578 | 3/1917 | Wise | 108/139 |
| 1,614,697 | 1/1927 | Snook | 269/16 X |
| 2,050,115 | 8/1936 | Nichols | 108/28 |
| 2,602,615 | 7/1952 | Maynard et al. | 248/13 |
| 2,654,147 | 10/1953 | Wilson et al. | 248/3 |
| 2,875,006 | 2/1959 | Hale | 108/28 X |
| 3,550,892 | 12/1970 | Propst | 108/152 X |
| 3,601,443 | 8/1971 | Jones | 108/103 X |

*Primary Examiner*—Roy D. Frazier

*Assistant Examiner*—Terrell P. Lewis

*Attorney, Agent, or Firm*—Richards, Harris & Medlock

[57] ABSTRACT

A tool holder apparatus for attachment to a workstand, particularly an engine workstand, is disclosed. The apparatus includes a support arm to be affixed to the workstand having a clamp on the lower end that affixes the support arm to the workstand and a vertical spindle on the upper end. A lower swivel arm is pivotally mounted at one end to the support arm spindle for movement in a horizontal plane. The lower swivel arm has a vertical spindle on the end opposite that which is attached to the support arm spindle and carries a lower tray thereon for rotational movement about the swivel arm spindle. The lower tray has a plurality of dividing walls defining separate bin areas for items of hardware for the engine being worked on. A spacer sleeve is placed around the support arm spindle above the lower swivel arm. An upper swivel arm is mounted at one end to the support arm spindle for pivotal movement in a horizontal plane about the portion of the spindle extending through the spacer sleeve. An upper tray is carried on the end of the upper swivel arm opposite the mounting end thereof. The upper tray is adapted for holding tools of various types.

3 Claims, 3 Drawing Figures

TOOL HOLDER APPARATUS FOR A WORKSTAND

BACKGROUND OF THE INVENTION

The present invention relates to an apparatus for facilitating the assembling or disassembling of an object mounted on a workstand. More particularly, the present invention relates to a repository for tools which attaches to a workstand that supports an engine to be assembled or dissassembled.

When major repairs, such as an engine overhaul, are required to be made to an automobile engine, it often becomes necessary to remove the engine from the automobile. After removal of the engine from the automobile, the engine is oftentimes supported on a workstand in order that the engine may be more easily worked on. Such engine workstands are typically provided with a support structure including a base portion that rests on the floor and an engine block adapter to couple and hold the engine.

During the repair of an engine, various tools are utilized, most of which are kept in various tool boxes, wall hangers and bench drawers. It has heretofore been found that it is quite inconvenient to the mechanic repairing an engine to be required to go to the various places that the necessary tools are stored; yet, it can also be very inconvenient and hazardous to have the tools strewn all about the floor of the work area.

In addition to the problems presented, and the time consumed, in procuring the tools from the various storage places, additional inconvenience is encountered in the handling of the hardware items for the engine. For example, many nuts and bolts, as well as subassemblies of the engine, are required to be removed from the engine during disassembling or replaced on the engine during assembly of a repaired engine. The necessity for maintaining an accounting of the hardware items for the engine is well known. However, it has heretofore been the case that a separate container must be obtained by the mechanic to hold the hardware items, which container must oftentimes be placed on the floor proximate the workstand area or on an adjacent workbench. In either case, it is inconvenient for the mechanic when a multitude of hardware items are to be handled to properly sort all hardware items into their proper separate container. If the mechanic is attentive to the sorting and accounting of the hardware items in this manner, the repair job being done on the engine will likely take a much longer time to complete.

Accordingly, it would be desirable to have a repository for both tools and hardware that could be positioned within the area of the workstand proximate the engine, and which would permit the mechanic quick and ready access to the necessary tools and further provide for the sorting and accounting of hardware items in an expeditious manner.

SUMMARY OF THE INVENTION

The present invention is directed to a tool holder apparatus for attachment to a workstand that supports an object, such as an engine, having hardware items that are to be assembled or disassembled through the use of various tools.

In accordance with the more general concepts of the present invention, a support arm to be affixed to a workstand support a first tray that is pivotally movable in a horizontal plane about the support arm and a second tray laterally displaced from the support arm and provided with pivotal movement in a horizontal plane above that of the first tray.

In its more particular aspects, apparatus in accordance with the present invention includes a support arm having structure on one end for mounting the arm to the workstand, with a vertically oriented spindle being on the opposite end of the arm. A lower swivel arm is pivotally mounted at one end for movement about the vertical spindle in a horizontal plane. A first tray is carried on the end of the lower swivel arm opposite that attached to the support arm spindle. An upper swivel arm is pivotally mounted at one end of the vertical spindle for movement thereabout in a horizontal plane. A second tray is carried on the end of the upper swivel arm opposite the end mounted to the support arm spindle.

in accordance with other more particular aspects of the present invention, the first and second trays are mounted on the ends of their respective swivel arms for rotational movement about an axis of rotation defined at the end of each arm. A strap can be further provided to define an opening of a predetermined cross-sectional configuration for receiving and supporting therein a rotary hand tool. Also, structure can be provided on the upper tray for removing hardware items from socketed tools. Finally, in accordance with the more particular aspects of the invention, the structure for mounting the support arm to the workstand can be a clamp comprising a first clamp section attached to the end of the support arm and a second clamp section to be bolted to the first clamp section.

DESCRIPTION OF THE DRAWINGS

A more complete appreciation of the invention may be had by reference to the accompanying drawings, illustrating a preferred embodiment of the invention, which is to be described in detail, wherein.

DESCRIPTION OF A PREFERRED EMBODIMENT

Figure 1:
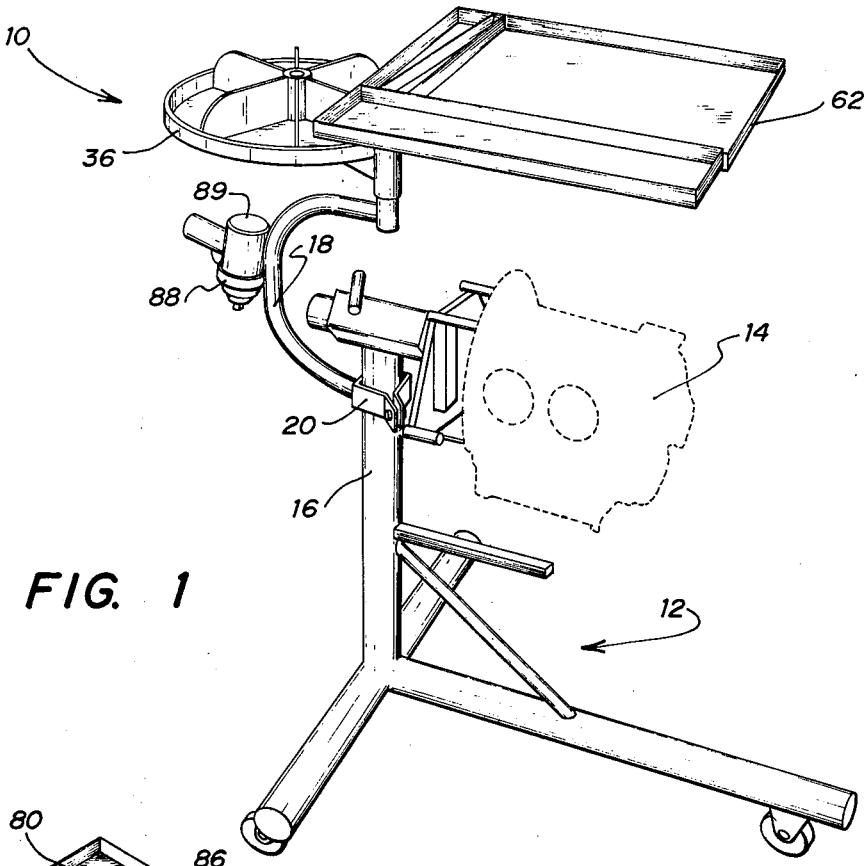
FIG. 1 is a perspective view of a tool holder apparatus in accordance with the present invention shown mounted to an engine workstand.

Referring now to the drawings, and more particularly to FIG. 1 thereof, there is shown a tool holder apparatus 10 in accordance with the present invention attached to an engine workstand 12, which has an engine block 14 supported thereon.

Tool holder apparatus 10 comprises a support arm 18 having clamp means 20 for attachment to workstand 12. A first tray 36 is supported by support arm 18. Tray 36 is laterally movable with respect to support arm 18. A second tray 62 is supported by support arm 18 to be displaced a distance from tray 36. Tray 62 is laterally movable with respect to support arm 18.

In the embodiment shown in the drawings, support arm 18 is a vertically extending member having clamp means 20 on the lower end for attaching the tool holder apparatus 10 to a structural member 16 of workstand 12. Trays 36 and 62 are carried on the upper end of arm 18 and provided with pivotal movement.

Figure 2:
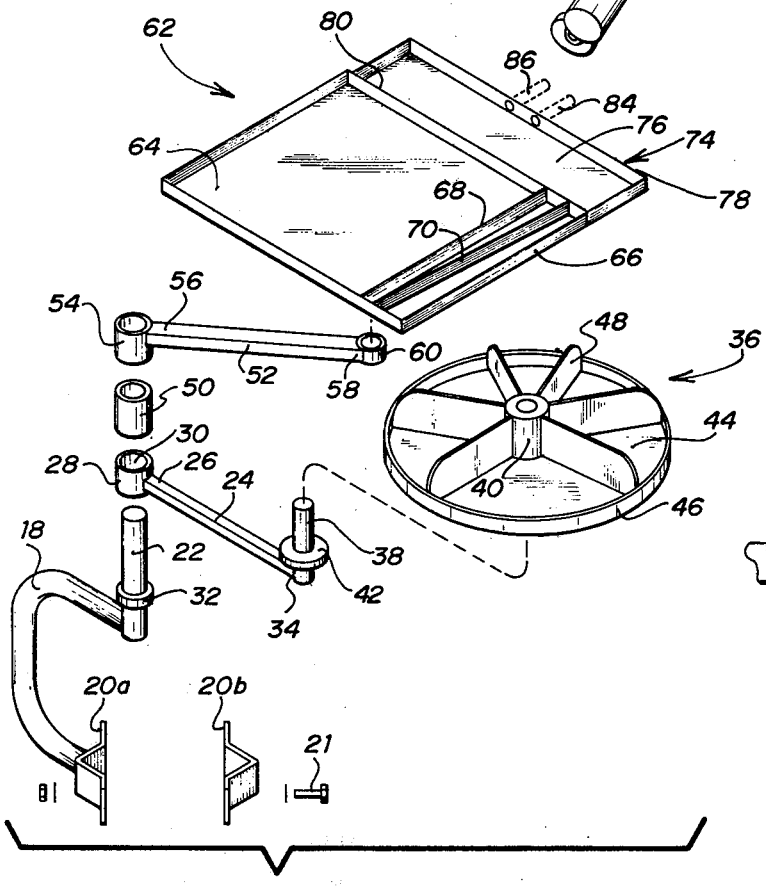
FIG. 2 is an exploded view of the tool holder apparatus.

Referring next to FIG. 2, support arm 18 is shown as a generally C-shaped tubular member. Clamp means 20 at the lower end of arm 18 comprises a first clamp section 20*a* and a second mating clamp section 20*b*. Clamp sections 20*a* and 20*b* are interconnected by bolts 21 that extend through mating ends of the clamp sections, causing the clamp sections to be drawn together into a firm clamping relationship with a structural member of a workstand, such as member 16. At the upper end of support arm 18, there is provided a vertical spindle 22. Due to the substantially C-shaped configuration of support arm 18, spindle 22 is substantially aligned with the center of clamp means 20.

A lower swivel arm 24 is pivotally mounted to spindle 22 at end 26 for movement about spindle 22 in a horizontal plane. Pivotal movement is provided by a collar 28 having an axial bore 30 for receiving spindle 22. Collar 28 bears against a bearing support ring 32 on the lowermost portion of spindle 22.

On the opposite end 34 of lower swivel arm 24, first tray 36 is carried for rotational movement about a vertical axis of rotation. A vertical spindle 38 on the opposite end 34 in combination with collar 40 on tray 36 provides for the rotational movement of tray 36 about spindle 38. Ring plate 42 on the lower most portion of spindle 38 provides a bearing surface on which the lower surface of hub 40 can ride.

Tray 36, in addition to hub 40 which is disposed in the center of the tray, further includes a bottom 44. Sidewall 46 extends around the periphery of bottom 44, and a plurality of radially extending divider walls 48 define separate bin areas for hardware. Divider walls 48 extend radially outwardly from hub 40 to sidewall 46.

A sleeve 50 is placed around support arm spindle 22 above collar 28 to displace upper swivel arm 52 upwardly away from lower swivel arm 24. Upper swivel arm 52 is an elongate member of a substantially rectangular cross-sectional configuration. Arm 52 has a collar 54 secured on end 56, which collar receives the portion of support arm spindle 22 that extends through spacer sleeve 50. Collar 54 in combination with spindle 22 provides upper swivel arm 52 with movement in a horizontal plane. On the end 58 of arm 52 opposite end 56, a second collar 60 is provided.

Figure 3:
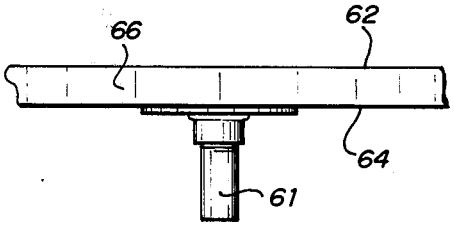
FIG. 3 is a detail view of the underside of the upper tray of the tool holder apparatus shown in FIGS. 1 and 2.

Tray 62 is carried on the end 58 of arm 52 for rotation about a vertical axis of rotation defined at end 58 by collar 60. As shown in FIG. 3, tray 62 has a shaft 61 to be inserted into collar 60 for rotation therein. Tray 62 comprises a bottom pan 64 having sidewall 66 extending around the entire periphery thereof. In addition, walls 68, 70 are provided at one end of tray 62 for holding sockets and the like. In the remainder of tray 62, various wrenches and other tools are held as shown.

In addition to tray 62, a side tray 74 can be provided. Side tray 74 comprises a flat bottom pan 76 having a sidewall 78 extending around the periphery thereof. Side tray 74, as shown, is attached to tray 62 along side 80.

Side tray 74 can be provided with outwardly extending projections 84 and 86 carried in the sidewall 78, which may be utilized to remove nuts from sockets, as is often encountered. Projections 84 and 86 may, for example, be threaded bolts placed within openings in sidewall 78 and held in place by a jam nut.

Referring once again in FIG. 1, mounted to support arm 18, at a point intermediate the ends thereof, is a strap 88. An opening in a predetermined cross-sectional configuration is defined by strap 88 for receiving and supporting therein a rotary hand tool 89, such as an air impact wrench or a drill.

Tool holder apparatus 10 facilitates a mechanic's work in assembling or disassembling engine 14, as the tools necessary for performing the repair work are kept in close proximity to the workstand. However, due to the movability of the upper and lower trays, the mechanic's ability to work around the engine and gain access to various portions thereof is in no way impeded. Accordingly, rather than spending a lot of time going back and forth between tool boxes and other tool storage areas, the mechanic has the necessary tools and hardware close at hand, yet, not in his way.

The foregoing description of the invention has been directed to a particular preferred embodiment for purposes of explanation and illustration. It will be apparent, however, to those skilled in this art that many modifications and changes in the apparatus may be made without departing from the scope and spirit of the invention. For example, the apparatus may be attached by means other than a clamp to the engine workstand. Also, the support arm can be formed in a different configuration and provide separate spindles for each of the trays. It is the intention in the following claims to cover all such equivalent modifications and variations as fall within the scope of the invention.

What is claimed is:

1. A tool and hardware holder apparatus for attachment to a workstand adapted to support an engine to be assembled or disassembled, which comprises:

a support arm having clamp means on the lower end to be affixed onto the workstand to extend above the workstand, and further including a vertically disposed spindle on the upper end;

a lower swivel arm having a collar on one end for receiving said spindle to pivotally mount said lower arm thereon for movement in a horizontal plane; said lower arm having a vertically disposed spindle on the end thereof opposite said collar;

a lower tray having a collar for receiving the spindle on the end of said lower swivel arm to provide for rotational movement of said tray about said spindle, said tray having a plurality of bins to hold separate items of hardware for the engine;

a spacer sleeve placed around said support arm spindle above the collar on said lower swivel arm;

an upper swivel arm having a first collar on one end for receiving the upper portion of said support arm spindle extending through said spacer sleeve to pivotally mount said upper arm for movement in a horizontal plane, said upper arm having a second collar on the opposite end;

an upper tray having a shaft affixed to its underside for insertion into the second collar on said upper arm to provide rotational movement thereof, said tray having a compartment for holding tools required in assembling or disassembling the engine; and a strap affixed to said holder apparatus defining an opening of a predetermined cross-sectional configuration for receiving and supporting in said opening a rotary hand tool.

2. The apparatus of claim 1, wherein said upper tray includes means for removing hardware items from socketed tools.

3. The apparatus of claim 2, wherein said clamp means comprises a first clamp section attached to the end of said support arm and a second clamp section to be bolted to said first clamp section.

* * * * *